United States Patent [19]

Ryan

[11] 4,269,534

[45] May 26, 1981

[54] REPLACEABLE GUIDE POST

[76] Inventor: John E. Ryan, 18113 Mt. Washington, Fountain Valley, Calif. 92708

[21] Appl. No.: 68,225

[22] Filed: Aug. 20, 1979

[51] Int. Cl.[3] ..... E01F 9/01

[52] U.S. Cl. ..... 404/10; 40/607; 256/1

[58] Field of Search ..... 404/10; 40/607; 256/13.1, 1; 52/749; 116/209

[56] References Cited

U.S. PATENT DOCUMENTS

| | | | |
|---|---|---|---|
| 1,337,947 | 4/1920 | O'Toole | 404/10 X |
| 1,802,940 | 4/1931 | Cornelius | 404/10 |
| 2,121,961 | 6/1938 | Gill | 404/10 |
| 3,212,415 | 10/1965 | Byrd | 404/10 |
| 3,371,647 | 3/1968 | Shopbell | 116/209 |
| 3,389,528 | 6/1968 | Abrams | 52/749 X |
| 3,709,112 | 1/1973 | Ebinger | 404/10 |
| 3,732,842 | 5/1973 | Vara | 404/10 X |
| 3,799,686 | 3/1974 | Williams | 404/10 |
| 4,123,183 | 10/1978 | Ryan | 404/10 |

*Primary Examiner*—Nile C. Byers, Jr.

*Attorney, Agent, or Firm*—Francis X. LoJacono

[57] ABSTRACT

A replaceable guide post of the type generally used as a road marker and the like, wherein a flexible tubular post member is provided with a mounting-base structure that is arranged to be secured to a ground surface such as a roadway. The base structure comprises a support-base member adapted to receive and engage a lower flanged portion of the tubular post and a retainer collar member, which is positioned over the base member and the lower portion of the guide post, thereby clamping the post therebetween and affixing the base member to the ground surface. An alternative arrangement thereof further includes a removable mounting-ring member provided with a central opening having the peripheral design of the particular tubular post to be employed therewith.

6 Claims, 15 Drawing Figures

FIG. 8
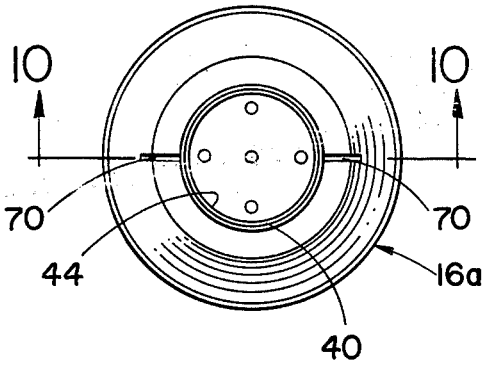
FIG. 9
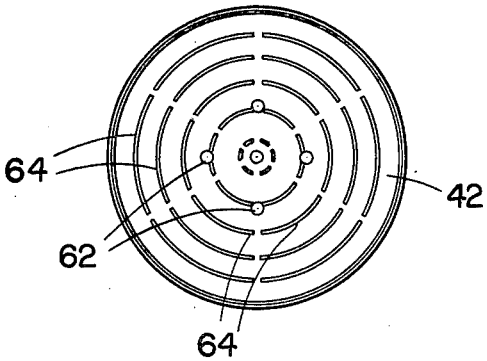
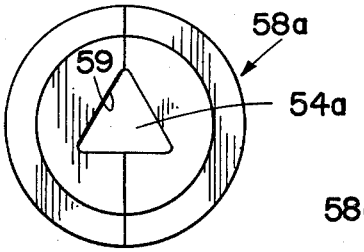
FIG. 13
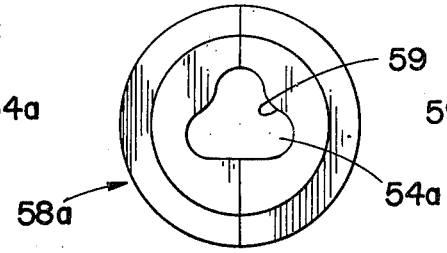
FIG. 14
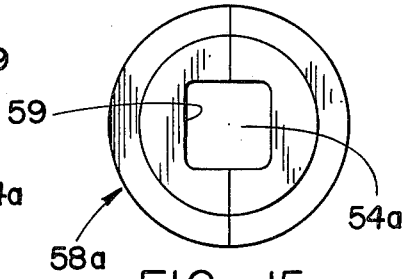
FIG. 15
FIG. 10
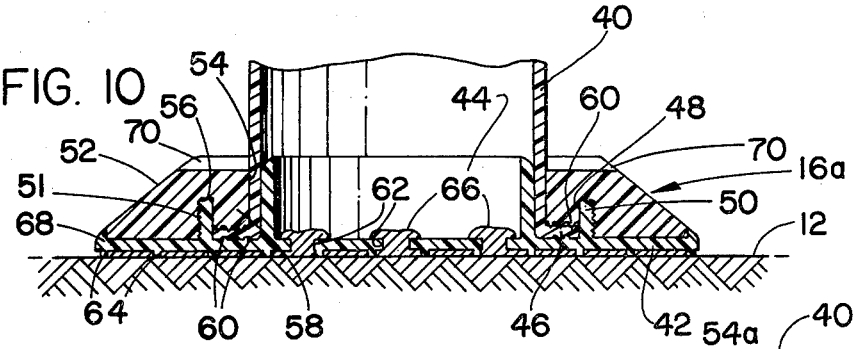
FIG. 11
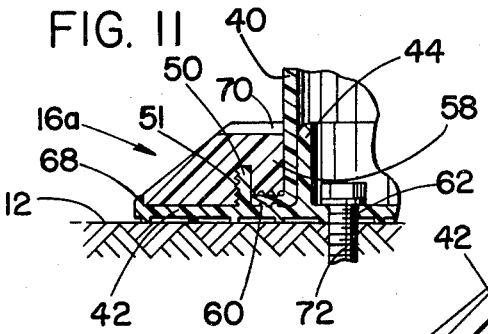
FIG. 12
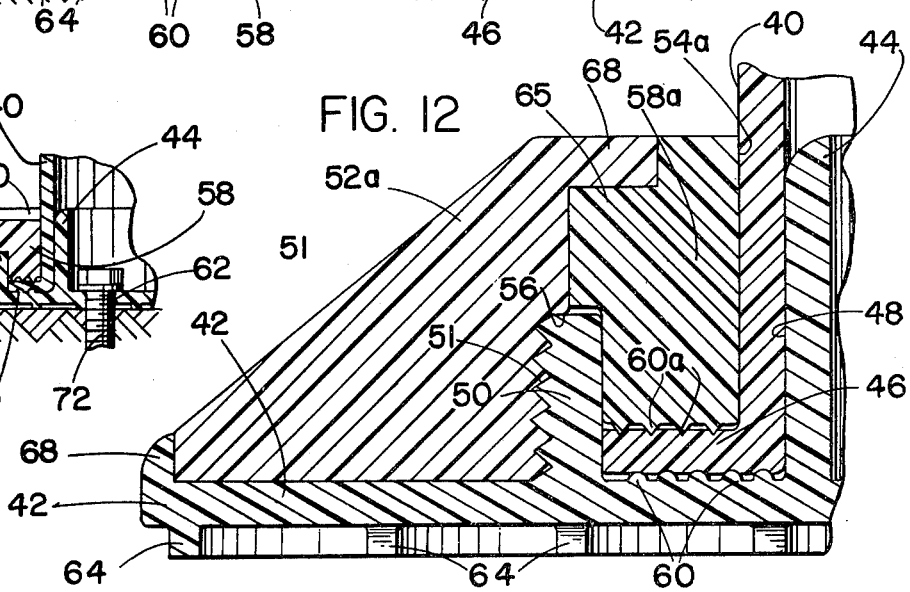

REPLACEABLE GUIDE POST

BACKGROUND OF THE INVENTION

1. Field of the Invention

This invention relates to guide or marker posts, and more particularly to guide or marker posts that are arranged to be replaceable by means of securing base structures.

2. Description of the Prior Art

As is well known in the art, various problems and difficulties are encountered in providing suitable means for installing guide or marker post units so that the post members can be readily replaced when damaged.

The known devices at the present time have features that restrict their use because they cannot be readily replaced, when necessary. These units are characterized by certain shortcomings in their preparation and application, these shortcomings being familiar to those manufacturing and employing such devices.

However, there are some markers that have been designed to overcome these difficulties, but these are still found to have inherent problems—such as, when they are struck by vehicles, the posts will separate from their bases, or the bases and the posts are both torn away from the ground structure.

As examples of several types of guide posts and markers, there are the following United States patents that have been issued in this field of invention.

A traffic-marking device by Gill, U.S. Pat. No. 2,121,961, having a very simple mounting structure of the type that provides a very-short life span for the unit.

U.S. Pat. No. 3,371,647 to Shopbell is a marker used on athletic fields and it does not require the structure for markers used on roadways and the like.

U.S. Pat. No. 3,389,528 to Abrams is a traffic guide post having a hollow base member to hold water, for weight-stabilizing purposes.

The guide picket disclosed in U.S. Pat. No. 3,709,112 to Ebinger just shows a tubular post inserted into a ground structure, without a base member.

In U.S. Pat. No. 3,799,686 to Williams the post member is constructed of a plurality of post portions united together by means of a steel cable having a mounting structure comprising a base plate and a pair of anchor bolts secured to the road surface.

U.S. Pat. No. 4,123,183 issued to the present inventor is also of the type that is structurally mounted within the ground surface—which device in itself lead to the improvement comprising the replaceable guide post, as herein disclosed.

SUMMARY AND OBJECTS OF THE INVENTION

The present invention comprises an elongated tubular body member of pliable plastic material defining a post member having an outwardly bent peripheral flange member. A mounting base-support structure is provided having a support-base-plate member which includes an upstanding annular wall adapted to be inserted into the lower-end opening of the post member, whereby the flange of the post is abutting the outer rim of the base plate—the outer rim being provided with a plurality of protruberances to engage the flange of the post from the underside. Protruberances are also provided on the underside of the mounting-collar member which engages the post flange. The oppositely disposed protruberances define a locking means that prevents the post from being pulled out from the base when struck by a vehicle.

Various arrangements of the mounting-base structure are herein described in detail, each base structure presenting an important object of the invention, whereby the post member can be readily replaced in a very simple manner.

It is another object of the invention to provide a guide post of this type that can be installed so that the base plate is permanently affixed to the ground surface by various securing means, and whereby only a mounting cap is required to be removed to allow the post to be replaced thereon.

It is still another object of the invention to provide a guide post of this character that is easily installed without special tools, and wherein the replacing of a post can be accomplished by unskilled workmen—thus solving an additional problem.

It is a further object of the invention to provide a device of this character that will reduce highway maintenance and the resulting cost.

It is still a further object of the invention to provide a device of this character that is easy to service and maintain, and that is relatively inexpensive to manufacture—yet simple and rugged in construction.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only:

FIG. 8 is a top-plan view of an alternative arrangement of the present invention;

FIG. 9 is a bottom-plan view thereof;

FIG. 10 is an enlarged cross-sectional view thereof taken substantially along line 10—10 of FIG. 8;

FIG. 11 is a partial cross-sectional view, showing the base plate secured to the ground surface by a bolt arrangement; and FIG. 12 is an enlarged, partial cross-sectional view, showing an alternative arrangement of the base structure having a fitting collar adapted to receive various configurations of post members through a central opening, as seen in the top-plan views of FIGS. 13, 14 and 15.

DESCRIPTION OF THE PREFERRED EMBODIMENT

Figure 1:
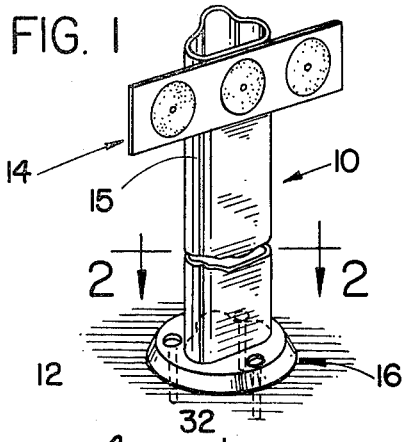
FIG. 1 is a perspective view of a replaceable guide post, showing the post as a road marker or the like having one type of a reflector means attached thereto.
Figure 5:
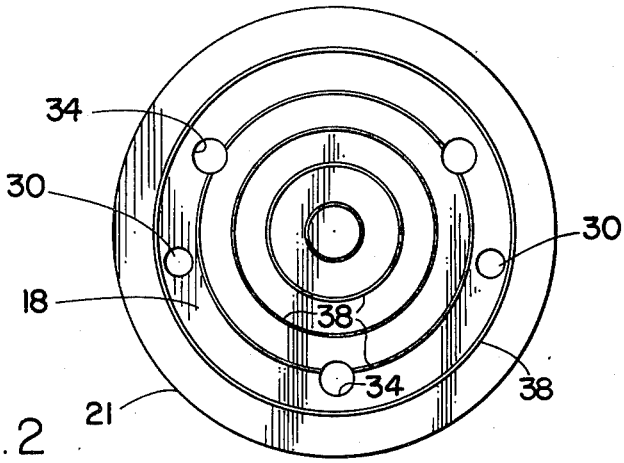
FIG. 5 is a bottom-plan view of the base structure.

Referring more particularly to FIG. 1, there is shown a road-marker guide post, generally indicated at 10, secured to a ground or road surface 12. The guide post has a reflector means, designated at 14, which is shown as one example since any suitable type of marker or reflector can be employed with the basic guide post arrangement.

Figure 2:
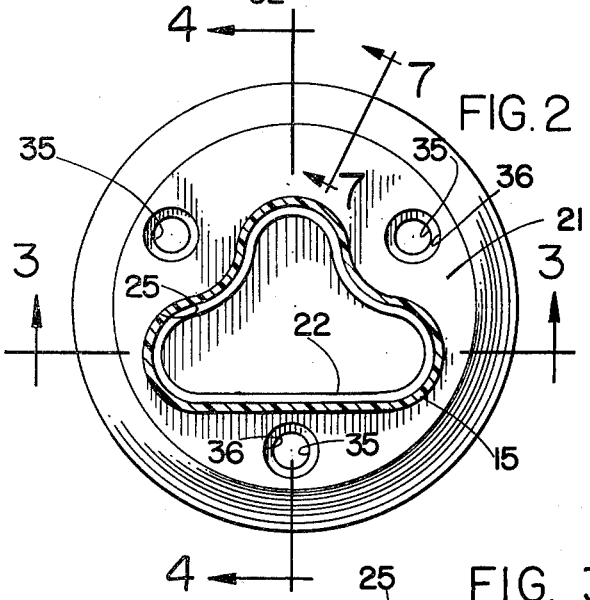
FIG. 2 is an enlarged cross-sectional view thereof taken substantially along line 2—2 of FIG. 1.
Figure 6:
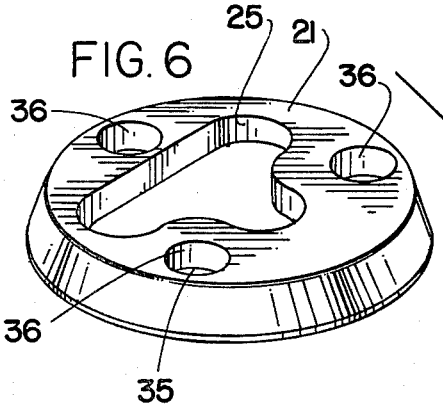
FIG. 6 is an exploded view of the base structure and the lower flanged portion of the post member.

In the present application, the guide post includes an elongated tubular-body structure 15, generally formed from a resilient or pliable plastic material. The tubular cross-sectional configuration, as indicated in FIGS. 1, 2 and 6, is only one form of the device. Other cross-sectional configurations can be employed, and will be hereinafter described.

It is well understood that such a guide post is subjected to extreme wear and tear. For example, this type of post may be struck numerous times by vehicles; and thus it should be constructed to withstand such abuse over long periods of time.

However, there is a replacement factor associated with guide markers; and, generally, it is the elongated-body structure 14 that is damaged—leaving the mounting base structure 16 unharmed and capable of re-use.

Figure 3:
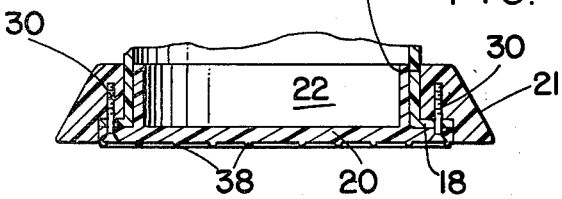
FIG. 3 is a cross-sectional view taken substantially along line 3—3 of FIG. 2.
Figure 3:
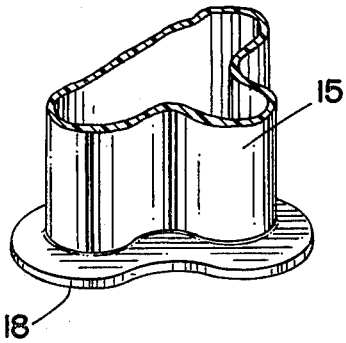
Figure 4:
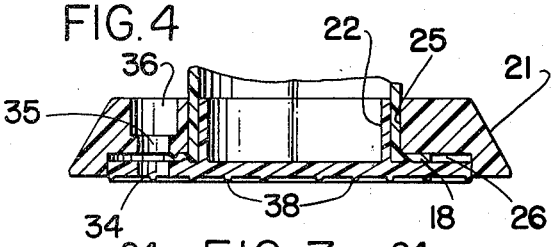
FIG. 4 is a cross-sectional view taken substantially along line 4—4 of FIG. 2.
Figure 4:
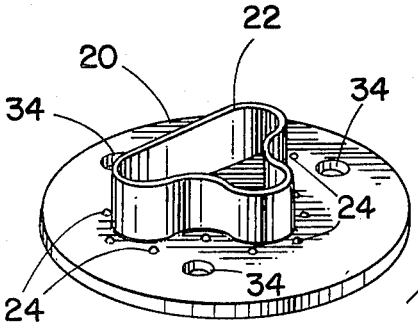
Figure 7:
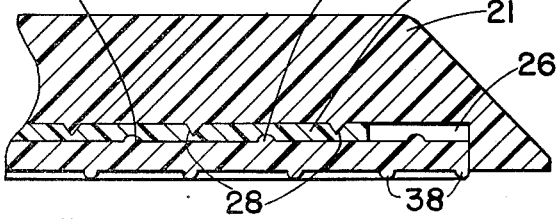
FIG. 7 is an enlarged cross-sectional view of the base structure taken along line 7—7 of FIG. 2.

The base portion of the elongated body-post member 15 includes a peripheral flange member 18, as seen in FIGS. 3, 4, 6 and 7, wherein flange 18 is received and positioned within base structure 16. The base structure comprises a base-support plate 20 having a substantially circular disc-shaped configuration and a mounting or retainer collar 29. The upper surface of the support plate 20 includes an integrally formed, upright, annular wall member 22, the wall member being formed with the identical peripheral configuration as that of the associated tubular post body 15. Thus, a very close fit is established therebetween. The upper surface of plate 20 further includes a plurality of upwardly projecting protruberances defined by nipple members 24. These nipple members can be formed having a domed spherical shape or a conical pointed configuration, so as to be forced into the abutting pliable flange member 18 of post 15, as seen in FIGS. 4 and 7.

Retainer collar 21 is also generally formed as a circular member having a central opening 25, opening 25 being provided with a configuration to receive the elongated post member 15 therethrough, and flange 18 thereof being received in a recess 26 formed in the bottom of retainer collar 21. Recess 28 is adapted to have a diameter that will accept base plate 20 therein, whereby flange 18 of post 15 is interposed between collar 21 and plate 20. The inner surface of recess 26 also includes a plurality of downwardly projecting nipple members 28 which engage the opposite or upper surface of flange 18. Thus, projecting nipples 24 and 28 lock post 15 in base structure 16, thereby defining a locking means to prevent post 15 from being pulled from base structure 16 when the guide post is struck with heavy force or blow by a vehicle.

The above-described embodiment further includes a means for securing retainer collar 21 and base plate 18 together, one such means being illustrated in FIG. 3 as removable pins or screws 30.

Accordingly, the guide post 10 must be secured to the ground surface 12; and this can be accomplished in two ways. One is by bolting the base structure 16 to the surface 2 by means of a plurality of bolts 32 which are mounted within aligned holes 34 and 35 of base plate 18 and collar 21, respectively, the holes 35 being provided with enlarged counter-sunk openings 36. The other method for securing the base structure is to bond the surface of the bottom of plate 20 to the ground surface 12, plate 20 being provided with a plurality of annular rib members 38. The rib members can be formed as continuous ribs or intermittent rib members, to allow for an even distribution of the bonding agent.

Referring now to the embodiment as illustrated in FIGS. 8 through 12—and more particularly to FIGS. 8 and 10—there is shown a mounting-base structure **16*a* in which is mounted and secured a cylindrical guide-post member 40. The base structure 16*a* comprises a base-plate member 42 integrally formed with an inner annular wall 44 extending upwardly from the base plate. As seen in FIG. 10, annular wall 44 is inserted within the cylindrical wall structure of post member 40, thus positioning post 40 centrally with respect to the base structure. Guide post 40 is provided with an annular flange member 46 which rests against base plate 42 and is received in an annular channel 48, defined by inner wall 44 and an outer annular wall 50, wall 50 being provided with a threaded outer surface 51**.

After guide post 40 is positioned in channel 48, retainer collar 52 is passed over post 40, collar 52 having a central circular opening 54, whereby collar 52 is threaded to base plate 42 by means of a threaded annular groove 56 formed therein.

Accordingly, retainer collar 52 includes a clamping ring 58 defined between opening 54 and groove 56. When retainer collar 52 is threaded to base plate 42, the clamping-ring portion 58 engages the upper surface of flange 46 and clamps the post against base plate 42. In addition, the opposing surfaces of ring 58 and channel 48 are provided with locking means defined by a plurality of rib members or individual nipples 60. The locking means is employed to prevent the flexible post from being pulled out from the base when great force is applied thereto, as when a vehicle runs into or over the post member.

Base plate 42 further comprises means for attaching the base plate to the ground surface 12. This can be accomplished either by bolting or by bonding of plate 42, as previously described. Thus, plate 42 includes a plurality of holes 62 and a plurality of annular rib members 64. In FIG. 10, the base member is shown secured to surface 12 by a bonding agent 65 comprised of any suitable known bonding material, such as epoxy. Thus, it can be seen that the bonding agent is evenly distributed between ribs 64 and is allowed to enter through holes 62, as at 66. However, it should be noted that a peripheral lip member 68 is formed along base 42, so as to prevent excess epoxy from contacting collar 52, whereby collar 52 can be removed when necessary by a suitable wrench that would be adapted to be received in lateral slots 70.

FIG. 11 illustrates the use of bolts 72 as an attaching means for plate 42, the bolt being secured to ground surface 12 through hole 62.

FIG. 12 is an enlarged cross-sectional view showing another embodiment of the present invention which comprises a base plate 42 having inner wall 44 and outer threaded wall 50, to which retainer collar **52*a* is removably attached. However, in this arrangement, collar 52*a* and clamping ring 58*a* are formed as two separate elements, wherein clamping ring 58*a* is provided with a central opening 54***a*, the central opening being formed to the configuration of the guide post 40.

Accordingly, if post 40 has the cross-sectional configuration of a triangle, a square, or other peripheral arrangements (as indicated in FIG. 6 herein), the central opening 54*a* should be provided with a corresponding peripheral wall 59, as illustrated in the examples of FIGS. 13, 14 and 15.

Clamping ring 58*a* further includes an annular shoulder member 65 which is adapted to be received in an annular recess 66 of collar 52*a*, the recess being defined by inwardly extending flange 68 which engages shoulder 65. Hence, when collar 52*a* is tightened to a clamping position on base 42, flange 68 forces clamping ring 58*a* into a locking engagement with flange 46 of post 40. FIG. 12 clearly illustrates the locking arrangement wherein flange 46 is interposed and locked between the protruberances 60*a* of ring 58*a*, and protruberances 60 of base plate 42.

Thus, it can be understood that, by having a separate clamping ring as at 58*a*, various post configurations are permitted to be employed with a base that can be readily separated therefrom.

Because of the various designs relating to the post 40, the upper end thereof being provided with different types of reflectors 14 (shown in FIG. 1), clamping ring 58*a* must be formed as two separate half members. This arrangement allows the clamping ring to be readily removed from a damaged post and used on the replacement post.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A guide post defining a road marker and the like, in combination, comprising:

an elongated, pliable, tubular body member defining a post member having a peripheral, outwardly disposed, flange member integrally formed at the bottom thereof;

a base structure adapted to be secured to a ground surface and arranged to receive therein the bottom-flanged portion of said post member;

said base structure comprising a support-base-plate member having an inner annular wall member adapted to be received within the bottom central portion of said post member, and an outer wall member threaded on one side thereof;

said inner and outer wall members defining an annular channel to receive said flange of said guide post therein;

a retainer collar having a central opening therein adapted to receive said post member therethrough, and including an annular threaded groove to receive said outer threaded wall of said base-plate member;

a clamping-ring member positioned to be received in said annular channel so as to be in locking engagement with said flange member of said post, and wherein the lower flange end of said post is interposed between said clamping ring and said inner wall member of said base structure; and a plurality of protruberances formed on the bottom surface of said clamping ring for locking engagement with said flange member of said post member.

2. A guide post as recited in claim 1, wherein the upper surface of said base plate in said channel is provided with a plurality of protruberances for locking engagement with said flange member of said post member.

3. A guide post as recited in claim 1, wherein said base-plate member includes a plurality of annular rib members formed on the bottom surface thereof for contact with the ground surface, and a plurality of holes so as to be associated with said securing means.

4. A guide post as recited in claim 3, wherein said securing means comprises a bonding agent disposed between said base plate and said ground surface, whereby said retainer collar can be removed and said post can be removed therefrom.

5. A guide post as recited in claim 3, wherein said securing means comprises a plurality of bolts adapted to be received in said holes located in said base plate and fixed to said ground surface.

6. A guide post as recited in claim 1, wherein said clamping ring is formed as a separate part of said retainer collar, whereby said retainer collar can be rotated freely from said clamping ring, said opening of said ring being provided with a peripheral wall having the same configuration as that of said post members.

* * * * *